US006886507B2

(12) United States Patent
Olson

(10) Patent No.: US 6,886,507 B2
(45) Date of Patent: May 3, 2005

(54) EXHAUST VALVE FOR TWO-CYCLE ENGINE

(76) Inventor: Darrell Olson, 29936 Highway 169 NW., Princeton, MN (US) 55371

( * ) Notice: Subject to any disclaimer, the term of this patent is extended or adjusted under 35 U.S.C. 154(b) by 0 days.

(21) Appl. No.: 10/407,146

(22) Filed: Apr. 4, 2003

(65) Prior Publication Data

US 2004/0194738 A1 Oct. 7, 2004

Related U.S. Application Data

(60) Provisional application No. 60/459,406, filed on Apr. 1, 2003.

(51) Int. Cl.[7] ..... F02B 75/02
(52) U.S. Cl. ..... 123/65 PE
(58) Field of Search ..... 123/65 PE

(56) References Cited

U.S. PATENT DOCUMENTS

| | | | | |
|---|---|---|---|---|
| 862,867 | A | * 8/1907 | Eggleston | 417/390 |
| 3,799,498 | A | 3/1974 | Wickham et al. | |
| 4,033,378 | A | 7/1977 | Pauliukonis | |
| 4,202,297 | A | 5/1980 | Oku et al. | |
| 4,285,357 | A | 8/1981 | Jones | |
| 4,321,893 | A | 3/1982 | Yamamoto | |
| 4,364,346 | A | 12/1982 | Shiohara | |
| 4,697,665 | A | 10/1987 | Eastman et al. | |
| 4,776,305 | A | 10/1988 | Oike | |
| 4,970,997 | A | 11/1990 | Inoue et al. | |
| 5,218,819 | A | 6/1993 | Cruickshank | |
| 5,220,890 | A | 6/1993 | Koriyama | |
| 5,337,707 | A | 8/1994 | Blundell et al. | |
| 5,588,402 | A | 12/1996 | Lawrence | |
| 5,678,404 | A | 10/1997 | McManus | |
| 5,873,334 | A | 2/1999 | Heinrich | |
| 5,904,122 | A | 5/1999 | Hayd | |
| 6,066,014 | A | 5/2000 | Smith et al. | |
| 6,102,363 | A | * 8/2000 | Eberwein | 251/63 |
| 6,158,215 | A | 12/2000 | Bosch et al. | |
| 6,189,494 | B1 | * 2/2001 | Nagumo et al. | 123/65 PE |
| 6,213,065 | B1 | 4/2001 | Kahlhamer | |

FOREIGN PATENT DOCUMENTS

JP 06280575 A * 10/1994 ..... F02B/25/20

* cited by examiner

*Primary Examiner*—Thomas Denion
*Assistant Examiner*—Zelalem Eshete
(74) *Attorney, Agent, or Firm*—Peterson, Thuente, Skaar & Christensen, P.A.

(57) ABSTRACT

An exhaust valve for a two-cycle engine. The exhaust valve includes a valve body and an actuator. The valve body, in turn, includes a valve insert and a shaft extending from the valve insert. A substantially axial slot may be defined on an upper surface of the valve insert. The actuator may include an actuator housing, the piston, an actuator spring, and an actuator cover. in the embodiment shown, the actuator housing defines a plurality of orifices and feelingly accommodates the piston. The piston may be mechanically connected to the valve body shaft and is biased toward a front surface of the actuator housing by a spring. The actuator cover may accommodate one end of the spring and cooperates with the actuator housing to define a generally cylindrical cavity therein.

16 Claims, 3 Drawing Sheets

EXHAUST VALVE FOR TWO-CYCLE ENGINE

CROSS-REFERENCES TO RELATED APPLICATIONS

This application claims priority under 35 U.S.C. § 119 (e) to, and hereby incorporates by reference, U.S. Provisional Application No. 60/459,406, filed 1 Apr. 2003.

BACKGROUND OF THE INVENTION

1. Field of the Invention

This invention relates to two-cycle engines and, in particular, this invention relates to exhaust valves for two-cycle engines.

2. Background

Two-cycle engines are widely used for applications such as snow blowers, water craft, all-terrain vehicles, snow mobiles, and the like. The two-cycle engine is generally economically produced because many of the components necessary for four-cycle engines are unnecessary. In contrast to four-cycle engines which use valves, the piston itself blocks and exposes intake and exhaust ports as the piston is reciprocally displaced during operation.

In contrast to four-cycle engines, two-cycle engines have two strokes: 1) intake/compression; and 2) power/exhaust. During the intake/compression stroke in the two-cycle engine, the piston travels upward, thereby generating a low-pressure area in the crank case below the piston and compressing an air/fuel/oil mixture in the cylinder above the piston. Higher atmospheric pressure surrounding the crankcase forces air through the carburetor or throttle valve and, in turn, forces the reed valve open to admit more of the air/fuel/oil mixture to the crankcase When air pressures in the crank case and surrounding atmosphere are approximately equal, the read valve then closes. During the power/exhaust stroke, the piston travels downward, thereby compressing the air or air/fuel/oil mixture in the crankcase. Also during the power/exhaust stroke, the piston movement begins to open transfer ports, thereby forcing the charge from the crankcase, through the transfer ports, and into the cylinder and head chamber. During the foregoing transfer, the exhaust expansion chamber causes a low pressure area to occur at the exhaust port. This low pressure causes spent charge (combusted air/fuel/oil mixture), from the previous stroke, to be drawn out into the exhaust, thereby allowing entry of the new charge.

As the piston travels during the intake/compression stroke the charge pressures are equalized between the cylinder and crankcase. As the piston continues the intake/compression stroke, the transfer ports are closed and the piston begins to compress the fresh charge. At this point, the exhaust port remains open and the piston forces spent charge out through the open exhaust port. As the spent charge is forced through the open exhaust port, a pressure wave is produced. The pressure wave usually impacts a baffle in the exhaust pipe and is deflected back through the exhaust port and toward the cylinder. The effect of the deflected pressure wave is to retain the unspent charge in the cylinder. As the piston continues to travel upwardly, it travels past the exhaust port, thereby trapping the new charge within the cylinder and head chamber for subsequent combustion. Hence, lowering the top (reducing the effective diameter) of the exhaust port causes the new charge to be trapped in the cylinder and head chamber.

In view of the foregoing, one would think that a low exhaust port top (an exhaust port with a relatively small diameter) would always be advantageous. However, a low exhaust port top is actually advantageous only at low rpm when the engine is producing relatively small amounts of exhaust gases. At higher rpm, the exhaust port top must be disposed at a higher position to allow time for the increased combustion pressure to be reduced to less than the atmospheric pressure present in the crankcase. If the cylinder gas pressure is higher than the crankcase gas pressure, exhaust gases will be forced into the crankcase, thereby contaminating the fresh charge and disrupting entry of the new charge into the cylinder. When the exhaust port closes or the exhaust gate is closed by the piston during the compression/intake stroke, the charge is compressed by the piston and at near top dead center, the charge is ignited by the ignition. The piston is then forced down to begin the two stroke cycle anew. Thus, during operation at high rpm, maximum power is attained if the exhaust (combustion products) is efficiently removed from the cylinder. Efficient removal of exhaust gases may be accomplished by comparatively large-diameter exhaust ports. However, a two-stroke engine designed to accommodate expeditious removal of exhaust is often inefficient at low rpm. Inefficiency at low rpm is due in part because the enlargement of the exhaust port diameter diminishes the compression within the cylinder, thereby allowing the uncombusted fuel/oil/air mixture to exit the exhaust port before being combusted. When uncombusted fuel/oil/air mixture is allowed to exit before being combusted, the amount of trapped charge available for combustion is reduced and the efficiency of the engine (as measured by the energy produced per unit fuel) is reduced.

There is then a need for a two-cycle engine which efficiently adjusts the diameter of the exhaust port to a smaller dimension for low rpm and a larger dimension for high rpm.

SUMMARY OF THE INVENTION

This invention substantially meets the aforementioned needs of the industry by providing an exhaust valve for a two-cycle engine. The exhaust valve may include a valve body and an actuator. The valve body may display a generally planar upper surface and a substantially axial slot defined from the valve body upper surface. The actuator may include a piston, an actuator housing, and a spring. The piston may be mechanically connected to the valve body. The actuator housing may sealingly accommodate the piston and may further define at least one orifice. The spring may be biased against the piston.

There is also provided a process for manufacturing an exhaust valve of the present invention, in which the effective diameter of an exhaust port of the two-cycle engine is altered. The process may include forming a valve body with a generally planar upper surface and a substantially axial slot defined from the valve body upper surface. The process may further include connecting the valve body to a piston, the piston sealingly disposed in an actuator housing. The process may still further include biasing the piston against the actuator housing with a spring.

It is a feature of the present invention to include a valve body having a generally planar upper surface and a substantially axial slot defined from the valve body upper surface.

It is an advantage of the present invention that exhaust gases are transferred efficiently to the exhaust valve via the axial slot on the valve body upper surface.

It is another feature of the present invention to include an actuator housing with at least one orifice with a relatively small diameter.

It is an advantage of the present invention that the at least one orifice acts as a buffer to slow the return of the valve body to a fully extended position.

It is yet another feature of the present invention to include a piston with a plurality of extension surfaces and a plurality of recessed surfaces, the recessed surfaces concentrically disposed between the extension surfaces.

It is yet another advantage of the present invention that pressure exerted by exhaust against the surfaces on the piston initially displaces the piston slowly, then more quickly until an equilibrium is attained.

These and other objects, features, and advantages of this invention will become apparent from the description which follows, when considered in view of the accompanying drawings.

It is understood that the above-described figures are only illustrative of the present invention and are not contemplated to limit the scope thereof.

DETAILED DESCRIPTION OF THE INVENTION

Comprehension of this invention can be gained through reference to the drawings in conjunction with a thorough review of the following explanation. Any references to such relative terms as front and rear, right and left, top and bottom, upper and lower, horizontal and vertical, or the like, are intended for convenience of description and are not intended to limit the present invention or its components to any one positional or spatial orientation. Representative examples of the teachings of the present invention, which examples utilize many of these additional features and methods in conjunction, will now be described in detail with reference to the drawings. This detailed description is merely intended to teach a person of ordinary skill in the art further details for practicing aspects of the present teachings and is not intended to limit the scope of the invention. Therefore, combinations of features and methods disclosed in the following detailed description may not be necessary to practice the invention in the broadest sense and are instead taught merely to particularly describe representative and preferred embodiments of the invention.

Figure 1:
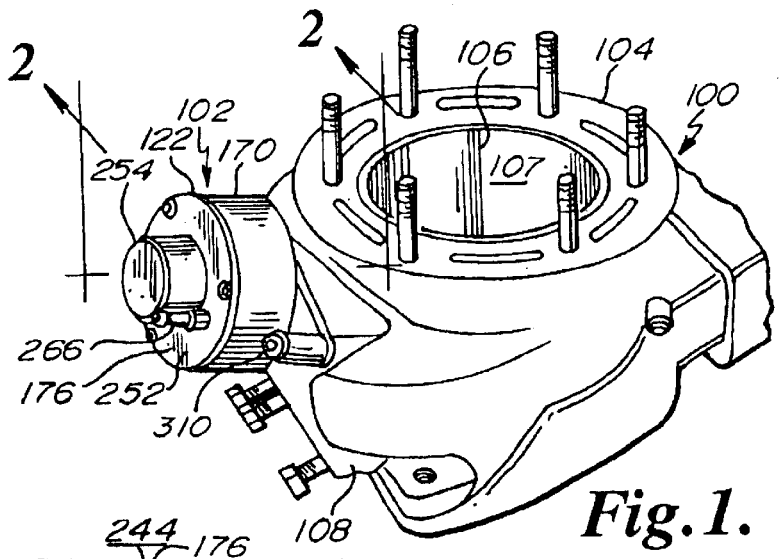
FIG. 1 is a perspective view of one embodiment of the present exhaust valve installed on a two-cycle engine block.
Figure 2:
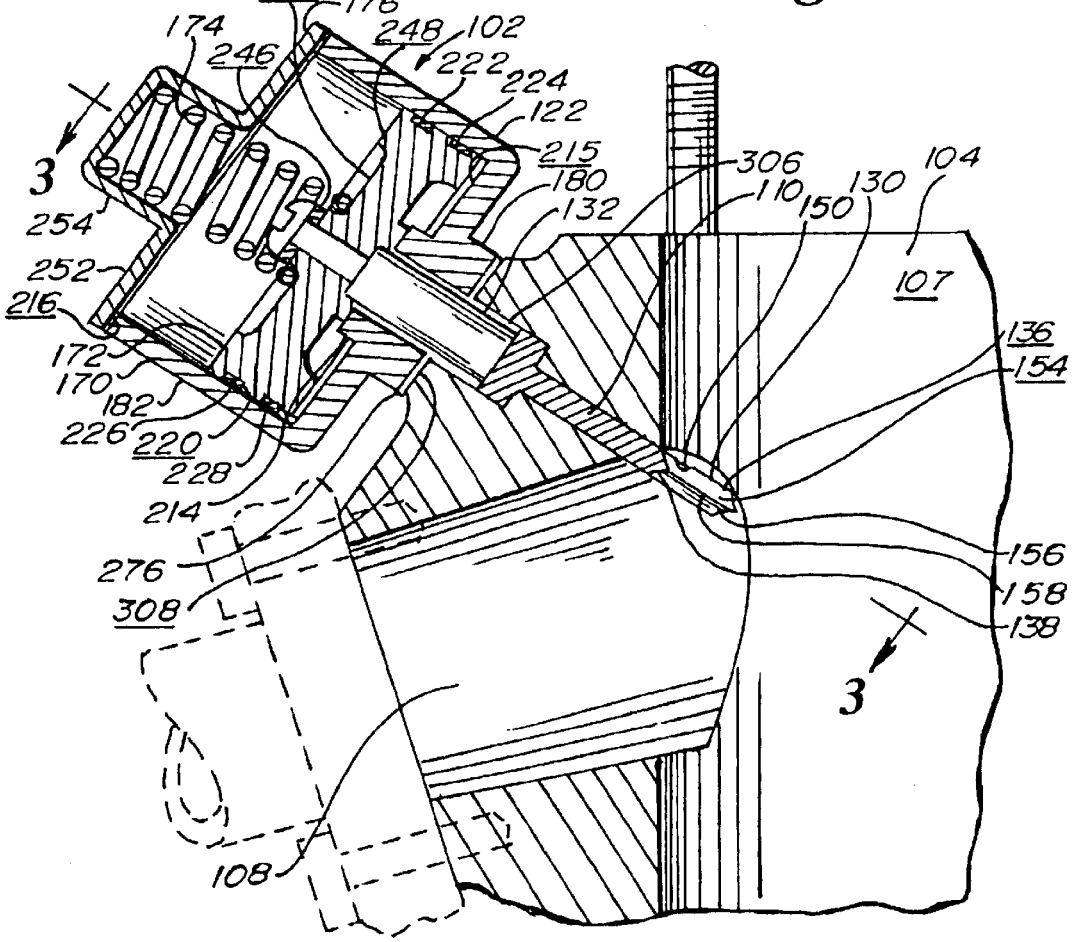
FIG. 2 is a partial cross section of the exhaust valve taken along line 2—2 of FIG. 1.
Figure 5:
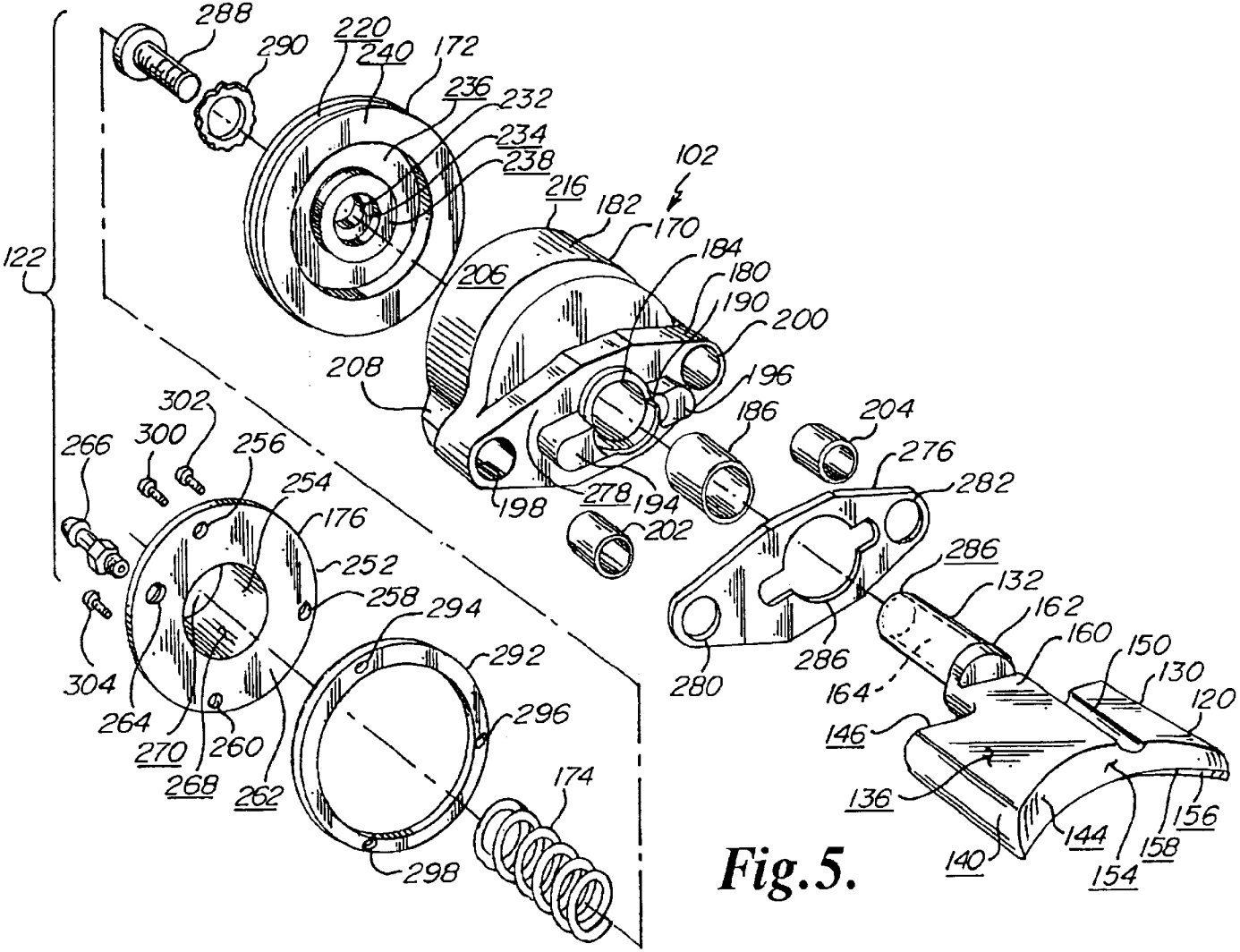
FIG. 5 is an exploded view of the exhaust valve of FIG. 1.

A two-cycle engine block 100 operatively fitted with an exhaust valve 102 of the present invention is depicted in FIGS. 1 and 2. The engine block 100 includes a block wall 104, the block wall 104 defining a cylinder 106, a cylinder wall 107 (FIG. 3), an exhaust port 108, and a valve slot 110. The cylinder 106 accommodates a piston (not shown). An exploded view of the exhaust valve 102 is depicted in FIG. 5, wherein a valve body 120 and an actuator 122 are shown.

In this embodiment, the valve body 120 unitarily (or otherwise integrally) includes a valve insert 130 and a shaft 132. The valve insert 130, in turn, displays substantially planar respective upper and lower surfaces 136 and 138 (FIG. 2), first and second lateral edge surfaces 140 and 142 (FIG. 4), a front edge surface 144, and a rear edge surface 146. The upper surface 136 defines a substantially axially aligned slot 150. The slot 150 extends between the front and rear edges 144 and 146. The first and second lateral edges 140 and 142 may be rounded. The generally arcuate front edge 144 may be formed by respective, sloped upper and lower surfaces 154 and 156. The surfaces 154 and 156 meet at an edge 158. The base 160 extends from the rear edge 146 and unitarily joins the shaft 132 at a disk-like member 162.

Figure 3:
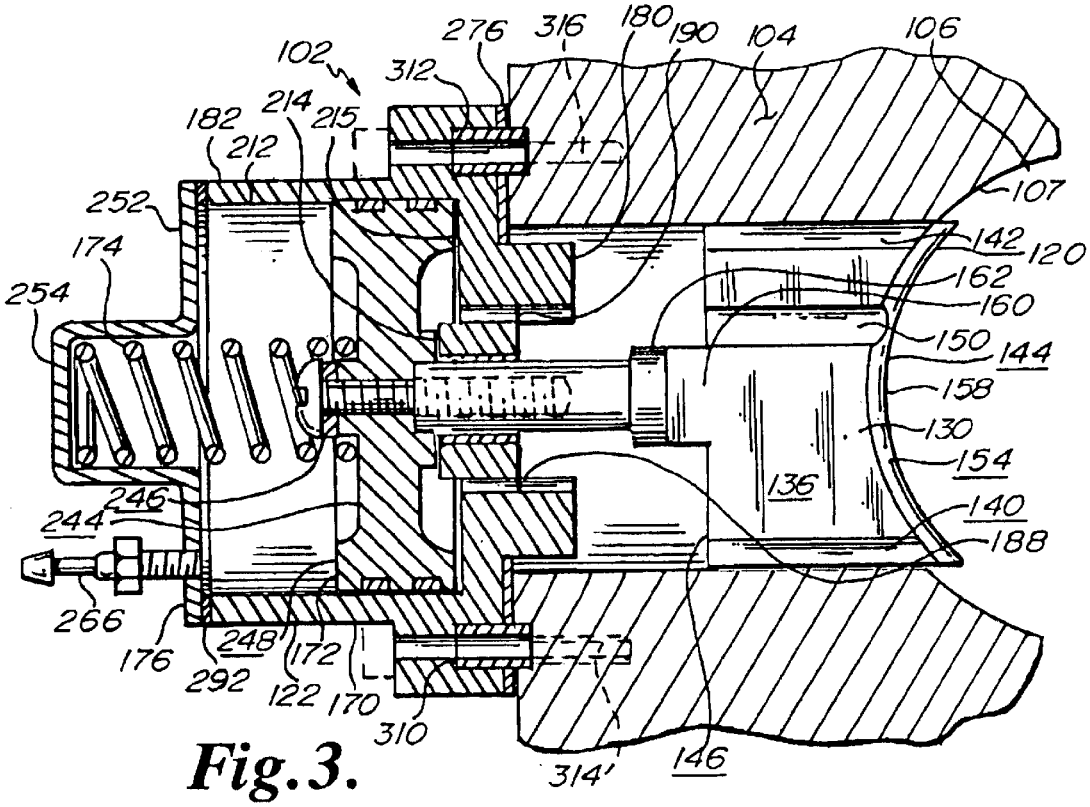
FIG. 3 is a cross section of the exhaust valve taken along line 3—3 of FIG. 2.

The actuator 122 may be considered to include an actuator housing 170, an actuator piston 172, an actuator spring 174, and an actuator cover 176. The actuator housing 170, in turn, may be unitarily (or otherwise integrally) formed from aluminum and may be considered to include an attachment portion 180 and a generally cylindrical portion 182 and defines a generally coaxial bore 184. The bore 184 accommodates a sleeve 186. The sleeve 186 snugly accommodates the shaft 132 of the valve body 120. The actuator housing 170 also accommodates a pair of orifices 188 and 190 (FIG. 3). The orifices 188 and 190 straddle the bore 184 in this embodiment. The attachment portion 180 includes a pair of projections of 194 and 196, which straddle the orifices 188 and 190. The attachment portion 180 also defines respective lateral bores 198 and 200, which are dimensioned to accommodate sleeves 202 and 204. The sleeves 202 and 204 accommodate bolts (not shown) when the exhaust valve 102 is installed in the engine block 100. The cylindrical portion 182 displays an outer surface 206 and a pair of lateral grooves 208 and 210 (not shown). The grooves 208 and 210 are dimensioned to accommodate the bolts extending through the sleeves 202 and 204. The cylindrical portion 182 also defines a cavity 212 (FIG. 3) and an annular extension 214 therein. The extension 214 surrounds the bore 184 and extends into the cavity 212 from a front surface 215. The cavity 212 is dimensioned to receive the actuator piston 172 therein. A rear rim 216 of the cylindrical portion 182 may accommodate three threaded bores therein (not shown).

Figure 4:
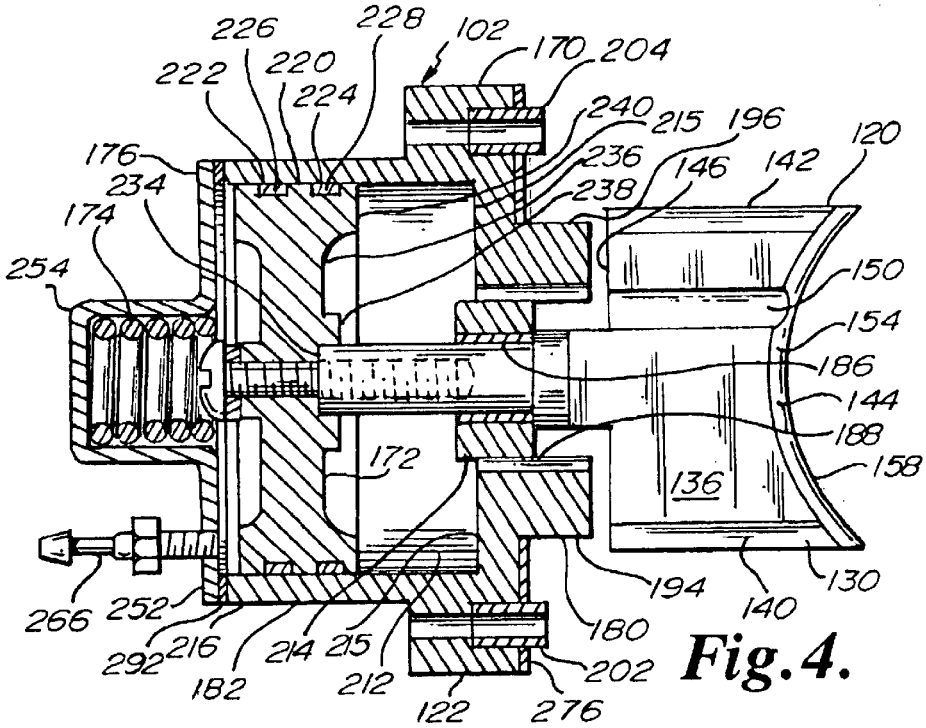
FIG. 4 is a cross section of the exhaust valve of FIG. 3 in a retracted position.

The actuator piston 172 displays a circumferential rim 220 and defines a pair of grooves 222 and 224 (FIG. 4). The grooves 222 and 224 accommodate a pair of rings 226 and 228. The circumferential rim 220 and rings 226 and 228 are dimensioned so as to achieve a substantially air-tight seal when the actuator piston 172 is operably disposed in the cavity 212 of the actuator housing 170. The piston 172 defines a generally axial bore 232 (FIG. 5). The front face of the piston 172 displays respective and annular inner and outer recessed surfaces 234 and 236, an annular inner extension surface 238, and an annular outer extension surface 240. The inner extension surface 238 is dimensioned to receive an end of the shaft 132 snugly therewithin. The rear face of the piston 172 displays a recessed surface 244 and respective inner and outer extension surfaces 246 and 248 (FIG. 2). The inner extension surface 246 substantially surrounds the bore 232 in this embodiment. The spring 174 is dimensioned so that an end thereof fits around the inner extension surface 246 and is thereby held in place when the present exhaust valve is assembled.

The actuator cover 176 (FIG. 5) is substantially unitary (or otherwise integral) in this embodiment, but may be considered to include a disk-like member 252 and an extension 254. The member 252 displays a front surface 262 and defines holes 256, 258, and 260. The holes 256, 258, and 260 substantially align with the threaded bores (discussed above) present proximate the rear rim 216 of the actuator housing 170. The member 252 also defines a hole 264. The hole 264 threadably accommodates a vent member 266. In the embodiment depicted, the extension 254 extends rearwardly from the member 252. An inner surface 268 of the extension 254 is dimensioned so as to substantially snugly accommodate in the spring 174. When the present exhaust valve is assembled, the spring 174 abuttingly contacts the rear surface 270.

During assembly, the sleeves 186, 202, and 204 may be pressed into respective bores 184, 198, and 200. A gasket 276 is then installed such that the gasket 276 contacts a front surface 278 of the attachment portion 180. The gasket 276 has holes 280 and 282 accommodating the sleeves 202 and 204 and another hole 280 for accommodating the sleeve 186 and the projections 194 and 196. The shaft 132 of the valve body 120 is extended through the sleeve 186 (the sleeve 186 having been pressed into the bore 184). The actuator piston 172 is then fixed to the shaft 132 by disposing the end of the shaft 132 within the inner extension surface 238 until an end surface 286 of the shaft 132 contacts the inner recessed surface 234 of the piston 172. The piston 172 is then affixed to the shaft 132 by using a connector such as a machine screw 288. The machine screw 288 is optionally extended through a washer 290, then threaded into the bore 164 of the shaft 132. A gasket 294 is then disposed to contact the front surface 262 of the actuator cover 176 such that holes 294, 296, and 298 of the gasket 292 align with respective holes 256, 258, and 260 of the actuator cover 176. One end of the spring 174 is then disposed around the inner extension surface 246 of the piston 172, such that the spring 174 contacts the recessed surface 244 thereof. The actuator cover 176 is then situated such that the other end of the spring 174 is disposed in the extension 254 and contacts the rear surface 270. Assembly is completed by aligning the holes 256, 258, and 260 with the holes proximate the rear rim 216 of the actuator housing 170 and threading connectors such as machine screws 300, 302, and 304 into the threaded holes proximate the rear rim 216 of the actuator housing 170. Components of the present exhaust valve have been made from aluminum. However, other satisfactory materials include titanium or steel ceramic. Satisfactory materials for the rings include Teflon®, iron, steel, aluminum, and other thermoplastics with the desired degree of tolerance to high temperatures and gas pressures.

Referring now to FIGS. 1 and 2, the assembled exhaust valve 102 is installed in the engine block 100. Installation is effected by inserting the valve insert 130 to the valve slot 110 of the engine block 100 and such that the slot 150 faces up, and such that the upper surface 136 contacts the block wall 104 of the engine block 100. At this point, the front end upper surface 154 will conform to the contours of the cylinder wall 107, the shaft 132 will be housed in a cylindrical enlargement 306 within the block wall 104, and the gasket 276 will contact an outer surface 308 of the engine wall 104. The exhaust valve 102 is then fixed to the engine block 100 by extending connectors such as machine screws 310 and 312 through the sleeves 202 and 204 (sleeves 202 and 204 having been pressed into bores 198 and 200) and threading the screws 310 and 312 (FIG. 3) into bores 314 and 316 (bores 314 and 316 being present in the block wall 104). One end of a piece of tubing (not shown) may be attached to the vent member 266 and the tubing routed away from the engine block 100.

When installed in a two-cycle engine, the present exhaust valve is operationally configured in a continuum between a fully extended position (FIG. 3) and a fully retracted position (FIG. 4). In the fully extended position, the spring 174 is minimally biased and presses the actuator piston 170 against the front surface 215 of the actuator housing cavity 212. Also in the extended position, the front edge upper surface 154 substantially aligns with the cylinder wall 107. In the fully retracted position, the valve insert 130 has been displaced away from the cylinder wall 107, thereby displacing the actuator piston 172 toward the actuator cover 176 and compressing the spring 174. In between the fully extended and retracted positions, the valve insert effects a continually changing effective exhaust port diameter in response to engine rpm by being displace in the continuum from the cylinder wall 107 to well away from the cylinder wall. The effective exhaust port diameter is at a minimum with the present valve insert is in the fully extended position and is at a maximum when the present valve insert is in the fully retracted position.

When the engine on which the present exhaust valve has been installed is operating at a low rpm speed, the pressure exerted by exhaust gases is at a minimum and the valve insert 130 is in a fully extended position. As the engine is operated at higher rpm, the pressure from exhaust gases increases. The increased pressure forces the exhaust gases through a tunnel formed by the slot 150 and the upper wall of the exhaust port 108, through the orifices 188 and 190, and into the actuator housing cavity 212. In the cavity 212 the exhaust gases exert pressure against the outer recessed surface 236 of the piston 172. When the present exhaust valve is in the fully extended position, the exhaust gases initially contact only the outer recessed surface 236. As the piston 172 becomes displaced backward, the exhaust pressure also exerts against the inner and outer extension surfaces 238 and 240 of the piston 172. The effect of this progressive exhaust gas pressure on the surfaces of the piston 172 is that the piston 172 is initially displaced slowly, then more rapidly as greater surface area is exposed to the pressure exerted by the exhaust gas. Exhaust gas pressure forces the piston 172 toward the actuator cover 176 and compresses the spring 174. The vent member 266 allows air in the cavity 212 between the piston 172 and the actuator cover 176 to be vented out as the spring 174 is compressed and admits air thereinto as the spring returns toward an unbiased position. At a given rpm, an equilibrium will be reached between the pressure exerted by exhaust gases on the piston 172 and the counter force exerted by the compressed spring 174. The equilibrium will depend on the amount of exhaust gas pressure present, hence on the engine rpm at any given instant. When in the fully extended position, the front edge 144 of the valve insert 130 substantially aligns with the cylinder wall 107 and effectively reduces the diameter of the exhaust port to configure the exhaust port to an optimum diameter for low rpm. When in the fully retracted position, the valve insert 130 is displaced away from the cylinder wall, effectively maximizing the effective diameter of the exhaust port for high engine rpm. The presence of the slot 150 on the valve insert upper surface 136 more efficiently conducts cylinder pressure into the present exhaust valve actuator. Hence, the present exhaust valve is more sensitive to cylinder pressure and more quickly displaces the valve insert 130 in response to changing exhaust gas pressure from changing engine rpm. In addition to admitting exhaust gases into the actuator housing cavity 212, the orifices 188 and 190 perform a buffering function as well. Because of the relatively small diameter of the orifices 188 and 190, compressed gases are vented back into the exhaust port rather slowly, thereby allowing the valve insert to slowly displace toward the fully extended position. The position of the slot 150 (extending from upper surface 136) is advantageous over other valves of the prior art. The slot 150 receives the exhaust pressure directly from the cylinder 106 and does so at the earliest possible instant. Exhaust pressures of 20–25 pounds per square inch are delivered to the present exhaust valve bore at or near maximum rpm in most two-cycle engine bores. By contrast, slots of the prior art disposed on a lower surface of the valve insert or as a bore (totally defined within the valve insert) receive pressure only from the exhaust ports of these engines. Pressure from the exhaust port would only be expected to be 1–1½ pounds per square inch at or near maximum rpm. The present exhaust valve also requires an actuator spring 174 with a greater degree of bias to offset the greater forces produced by cylinder exhaust gas pressures. By contrast, the exhaust valves of the prior art would require springs with a lower degree of bias—due to the much lower gas pressures from exhaust ports. Because of the greater gas pressure (from the cylinder) utilized in the present exhaust valve and greater amount of offsetting forces generated by the springs, the present exhaust valve is more responsive to rapidly changing engine rpm, i.e., opening and closing more quickly.

A person of ordinary skill in the art will recognize that the type and size of spring 174, diameter of the orifices 188 and 190, and the cross sectional dimension of the slot 150 can be altered to accommodate engines with differing rpm ranges. A person of ordinary skill in the art will also recognize that the sizes of the various components of the present exhaust valve can be altered to accommodate engines of differing sizes and configurations.

A person of ordinary skill in the art will readily appreciate that individual components shown on various embodiments of the present invention are interchangeable and may be added or interchanged on other embodiments without departing from the spirit and scope of this invention and without undue experimentation.

Because numerous modifications of this invention may be made without departing from the spirit thereof, the scope of the invention is not to be limited to the embodiments illustrated and described. Rather, the scope of the invention is to be determined by the appended claims and their equivalents.

What is claimed is:

1. An exhaust valve for altering the effective diameter of an exhaust port of a two-cycle engine, the exhaust valve comprising:

a valve body displaying an upper surface, a front edge, and a rear edge, and a substantially axial slot defined from the valve body upper surface and conveying compressed gases from the front edge to the rear edge; and an actuator comprising a piston in mechanical communication with the valve body, an actuator housing accommodating the piston and comprising an orifice, and a spring biased against the piston, the actuator body orifice receiving compressed gases conveyed by the valve body slot or from said exhaust port and further conveying said compressed gases into the actuator housing.

2. The exhaust valve of claim 1, in which the piston includes a front face, the front face including a substantially annular inner extension surface, an outer extension surface, an inner recessed surface, and an outer recessed surface.

3. The exhaust valve of claim 2, in which the valve body includes a shaft and in which an end portion of the shaft is accommodated within the inner extension surface of the piston.

4. The exhaust valve of claim 3, the actuator further comprising an actuator cover, the actuator cover including an extension accommodating an end portion of the spring.

5. The exhaust valve of claim 1, in which the valve body comprises a front edge configured to substantially align with a cylinder wall of the two-cycle engine.

6. The exhaust valve of claim 5, in which the valve body front edge is substantially arcuate.

7. The exhaust valve of claim 6, in which the valve body front edge is beveled to comprise an upper surface and a lower surface, the upper surface substantially aligning with the cylinder wall.

8. The exhaust valve of claim 1, in which a plurality of orifices are present in the actuator housing.

9. The exhaust valve of claim 8, in which the valve body slot and plurality of orifices cooperate to pneumatically communicate the piston and the exhaust port.

10. The exhaust valve of claim 1, further comprising a ring, the piston comprising a slot accommodating the ring.

11. The exhaust valve of claim 10, in which a pair of rings are present and in which the piston comprises a pair of slots, each of said slots accommodating one of the pair of rings.

12. A two-cycle engine in combination with the exhaust valve of claim 1, said exhaust valve operably installed for altering the effective diameter of the exhaust port.

13. A process of adjusting the effective diameter of an exhaust port of a two-cycle engine equipped with an exhaust valve and an actuator, the exhaust valve including a valve insert having a substantially axial slot defined on an upper surface thereof and extending between a front edge of the valve insert and a rear edge of the valve insert, the actuator having an actuator body with at least one orifice, a piston operably disposed in the actuator body and in mechanical communication with the valve insert, and a spring biasing the piston toward a fully extended position, the process comprising:

operating the engine at a low rpm, wherein the valve insert is in a fully extended position and the effective diameter of the exhaust port is at a minimum; and operating the engine at a higher rpm, wherein increased exhaust pressure forces exhaust through the valve insert axial slot, through the actuator body orifice, and into an interior of the actuator body, wherein the exhaust exerts a pressure upon the cylinder, thereby retracting the valve insert and increasing the effective exhaust port diameter.

14. An exhaust valve for altering the effective diameter of an exhaust port of a two-cycle engine, the exhaust valve comprising:

a valve body displaying a front edge, and a rear edge and defining structure extending axially in the valve body, said structure fluidly communicating the front edge and the rear edge; and an actuator comprising a piston in mechanical communication with the valve body, an actuator housing sealingly accommodating the piston and comprising an orifice, and a spring biased against the piston, said orifice in fluid communication with said structure defined in said valve body for fluidly communicating the front edge and the rear edge of the valve body.

15. An exhaust valve for altering the effective diameter of an exhaust port of a two-cycle engine having a cylinder reciprocally accommodating a piston, the exhaust valve comprising:

a valve body comprising an upper surface and a substantially axial slot defined in the valve body upper surface; and an actuator comprising an actuator housing, a spring, and a piston, the actuator housing having an orifice and reciprocally accommodating the piston, the piston in mechanical communication with the valve body, the spring disposed in the actuator housing and biasing the valve body in an extended position, the valve body slot conducting pressurized gases directly from said cylinder as the piston is initially displaced in a downstroke, the actuator housing orifice receiving pressurized gases from the exhaust port as the piston is further displaced in the downstroke.

16. An exhaust valve for altering the effective diameter of an exhaust port of a two-cycle engine, the two-cycle engine having a cylinder reciprocally accommodating a piston, the exhaust valve comprising:

a valve body comprising an upper surface, the upper surface defining a substantially axial slot; and an actuator comprising:

an actuator housing defining an orifice, a piston reciprocally accommodated in the actuator housing and in mechanical communication with the valve body, the piston having an inner extension positioned to align with the actuator housing orifice and a recessed surface radially extending from the inner extension, and a spring exerting a bias against the piston, said valve body slot conveying pressurized gases directly from the cylinder when the piston is in an initial position of a downstroke, said pressurized gases conveyed from the valve body slot entering said actuator housing orifice and exerting an initial force only on said piston inner extension thereby initially displacing said piston toward said spring, said pressurized gases exerting a subsequent force on said piston inner extension and on said piston recessed surface after said piston is initially displaced, said piston displacement altering said effective diameter of said exhaust port by displacing said valve body within a continuum bounded between a fully extended position and a filly retracted position.

* * * * *